US005465507A

United States Patent [19]

Schumacher et al.

[11] Patent Number: 5,465,507

[45] Date of Patent: Nov. 14, 1995

[54] INTEGRAL SOLE WITH FOOTPRINT EMBOSSING

[75] Inventors: James H. Schumacher, Hot Springs, Ak.; Donald L. Mills, Monett, Mo.

[73] Assignee: OSAGE Footwear, Inc., Monett, Mo.

[21] Appl. No.: 227,317

[22] Filed: Apr. 13, 1994

[51] Int. Cl.[6] ..... A43B 5/00; A43B 13/12

[52] U.S. Cl. ..... 36/30 R; 36/31; 36/114; 36/59 R

[58] Field of Search ..... 36/59 R, 59 A, 36/59 C, 31, 32 R, 25 R, 112, 1, 30 R, 114

[56] References Cited

U.S. PATENT DOCUMENTS

| | | | |
|---|---|---|---|
| 33,436 | 10/1861 | Kinsley | 36/59 A |
| 299,840 | 6/1884 | Norman | 36/31 |
| 416,861 | 12/1889 | Scafe | 36/59 A |
| 997,657 | 7/1911 | Drake | 36/59 A |
| 2,328,242 | 8/1943 | Witherill | 36/59 C |
| 4,216,132 | 8/1980 | Zweig et al. | 36/87 |
| 4,335,530 | 6/1982 | Stubblefield | 36/30 R |
| 4,378,641 | 4/1983 | Tarlow | 36/59 C |
| 4,398,357 | 8/1983 | Basra | 36/31 |
| 4,559,723 | 12/1985 | Hamy et al. | 36/114 |
| 4,564,966 | 1/1986 | Chen | 36/31 |
| 4,659,596 | 4/1987 | Karim | 36/32 R |
| 4,694,591 | 9/1987 | Banich et al. | 36/31 |
| 4,777,738 | 10/1988 | Giese et al. | 36/32 R |
| 4,897,936 | 2/1990 | Fuerst | 36/31 |
| 5,077,916 | 1/1992 | Beneteau | 36/59 R |

FOREIGN PATENT DOCUMENTS

| | | | |
|---|---|---|---|
| 601278 | 11/1925 | France | 36/59 A |
| 1431230 | 1/1966 | France | 36/59 C |
| 1478 | of 1883 | United Kingdom | 36/31 |

*Primary Examiner*—Steven N. Meyers
*Attorney, Agent, or Firm*—Larson and Taylor

[57] ABSTRACT

An integral sole for a shoe includes a base plate, a stabilizing plate, and a heel member. The base plate is made of a cushioning material and includes a lower surface having a footprint embossing which engages a walking surface providing traction and comfort for the user. The stabilizing plate is horizontally located about and surrounding the footprint embossing and is made of a material which is harder than the material of the base plate. The stabilizing plate also engages the walking surface and includes a bridge portion extending outwardly from a toe and ball portion of the footprint embossing to provide lateral stability for the sole. The heel member is located peripherally about a heel portion of the stabilizing plate. The heel member is made of a material which is harder than the material of the stabilizing plate to provide a firm heel stability for the shoe. Preferably, the toe portion of the footprint embossing includes five separate toe-print areas. The base plate, the stabilizing plate and the heel member are preferably made of a styrene-butadiene-styrene material, where: the base plate has a durometer value of about 40, the stabilizing plate has a durometer value of about 53, and the heel member has a durometer value of about 65. To provide flexibility for the sole, the stabilizing plate has an outer edge with flex vents laterally adjacent a ball area of the footprint embossing.

18 Claims, 3 Drawing Sheets

INTEGRAL SOLE WITH FOOTPRINT EMBOSSING

FIELD OF THE INVENTION

The present invention relates generally to a sole for a shoe, and more particularly to a 3-piece, 3-dimensional, 3-density unit outsole molded together as a singular unit sole for a shoe which has a soft flexible cushioned footprint embossing, a harder stabilizing plate about the footprint embossing, and (preferably) a still harder stabilizing heel member.

BACKGROUND OF THE INVENTION

Various soles for shoes are known, including those for babies and toddlers. However, such soles may be so stiff as to restrict natural foot movement and motion. The needs of the young developing foot are indeed three dimensional, back-part stability, forepart flexibility, cushioning and traction.

SUMMARY OF THE INVENTION

In accordance with the present invention, an integral sole for a shoe includes a base plate, a stabilizing plate, and preferably a heel member. The base plate is made of a cushioning material and includes (a) an upper surface to which an upper of the shoe is attached and (b) a lower surface having a footprint embossing opposite the position taken by a foot of a user in the upper. This footprint embossing engages a walking surface when the shoe is worn, providing traction and comfort for the footprint area of the foot of the user. The stabilizing plate is horizontally located about and surrounding the footprint embossing of the base plate. The stabilizing plate is attached to the base plate and is made of a material which is harder than the material of the base plate. The stabilizing plate also engages the walking surface and includes a bridge portion extending outwardly from a toe and ball portion of the footprint embossing which provides lateral stability for the sole. The heel member is located peripherally about a heel portion of the stabilizing plate and is attached to the base plate and to the stabilizing plate. The heel member is made of a material which is harder than the material of the stabilizing plate to provide a firm heel stability for the shoe.

In a preferred embodiment, the toe portion of the footprint embossing is separate from a remainder of the footprint embossing, and most preferably includes five separate toe-print areas. In addition, the footprint embossing also has a heel area and a ball area which are joined.

In the preferred embodiment, the heel member includes a lower surface which is located vertically below an adjacent lower surface of the stabilizing plate and vertically equal to a lowest portion of an adjacent lower surface of the footprint embossing of the base plate. In addition, the stabilizing plate includes an outer edge extending from one arch around the front to the other arch, the outer edge including a depending lip which extends vertically to a same position as the lower surface of the footprint embossing. The lower surface of the footprint embossing is also located vertically below the lower surface of the stabilizing plate adjacent thereto, and the footprint embossing includes ridges and valleys in the lower surface thereof.

The base plate, the stabilizing plate and the heel member are made of a styrene-butadiene-styrene material in the preferred embodiment. With this preferred material, or with other materials known in the art, the base plate has a durometer value of about 40, the stabilizing plate has a durometer value of about 53, and the heel member has a durometer value of about 65.

To provide flexibility for the sole, the stabilizing plate has an outer edge which extends about a toe end of the sole, and the outer edge laterally adjacent a ball area of the footprint embossing then includes a plurality of flex vents therein which extend inwardly and upwardly from the edge. Advantageously, the base plate further includes an upper surface with cutouts therein in a heel portion thereof for greater flexibility.

It is a advantage of the present invention that a comfortable and integral sole of a shoe is provided.

It is also an advantage of the present invention that the footprint area of the foot of the user which is designed to primarily contact the walking surface naturally also exerts force through the sole primarily through the softest or most cushioned part of the sole.

It is a further advantage of the present invention that the sole provides stability against lateral movement of the foot while still providing a cushioned footprint area, which is particularly advantageous for children.

It is yet another advantage of the present invention that the sole provides a relatively rigid heel while still providing a cushioned footprint area, which is particularly advantageous for children trying to walk in a forward direction.

Other features and advantages of the present invention are stated in or apparent from detailed descriptions of presently preferred embodiments of the invention found hereinbelow.

BRIEF DESCRIPTION THE DRAWINGS

DETAILED DESCRIPTION OF THE PREFERRED EMBODIMENTS

Figure 1:
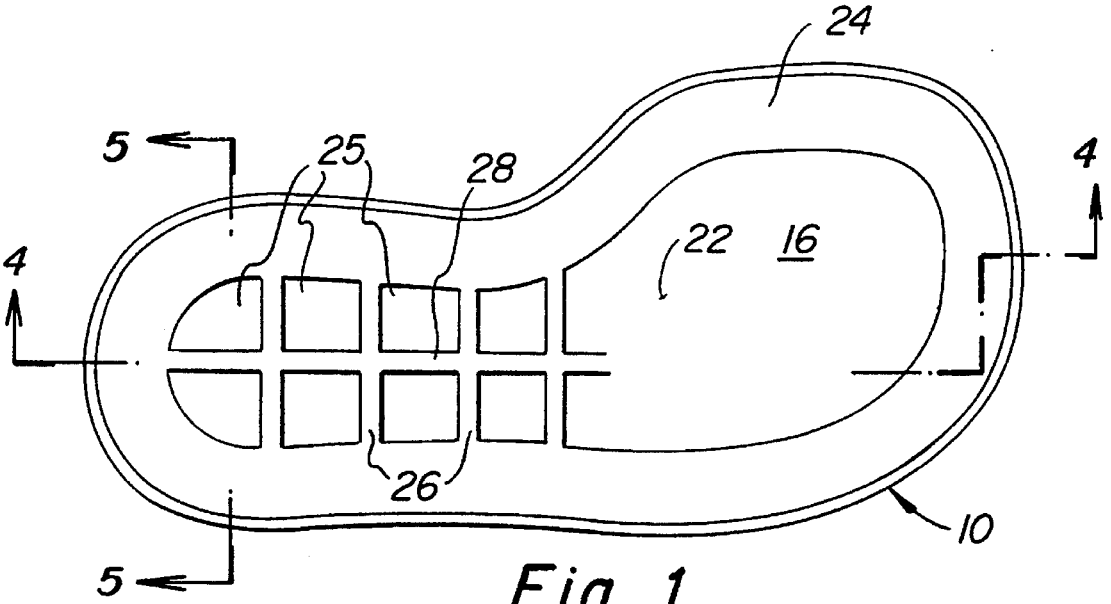
FIG. 1 is a top plan view of a sole of the present invention.
Figure 2:
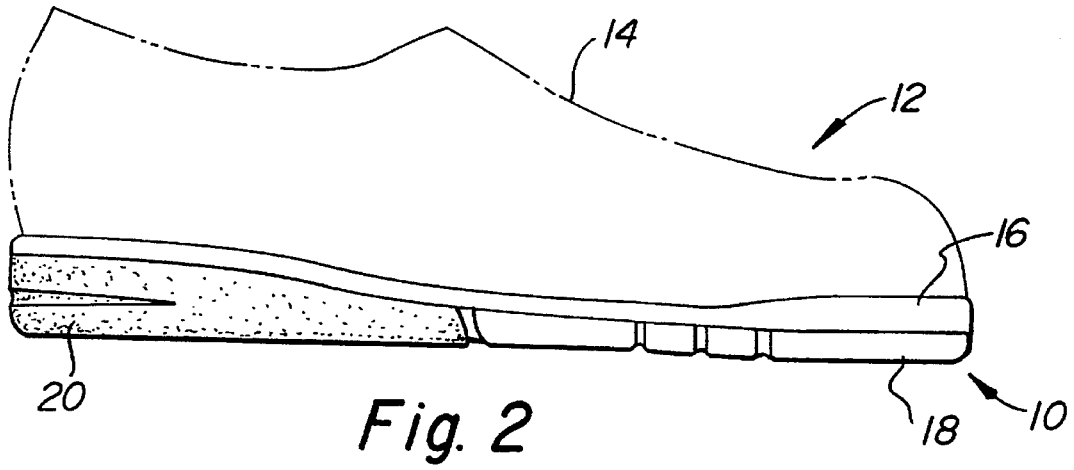
FIG. 2 is a front elevation view of the sole depicted in FIG. 1 with an upper depicted in phantom.
Figure 3:
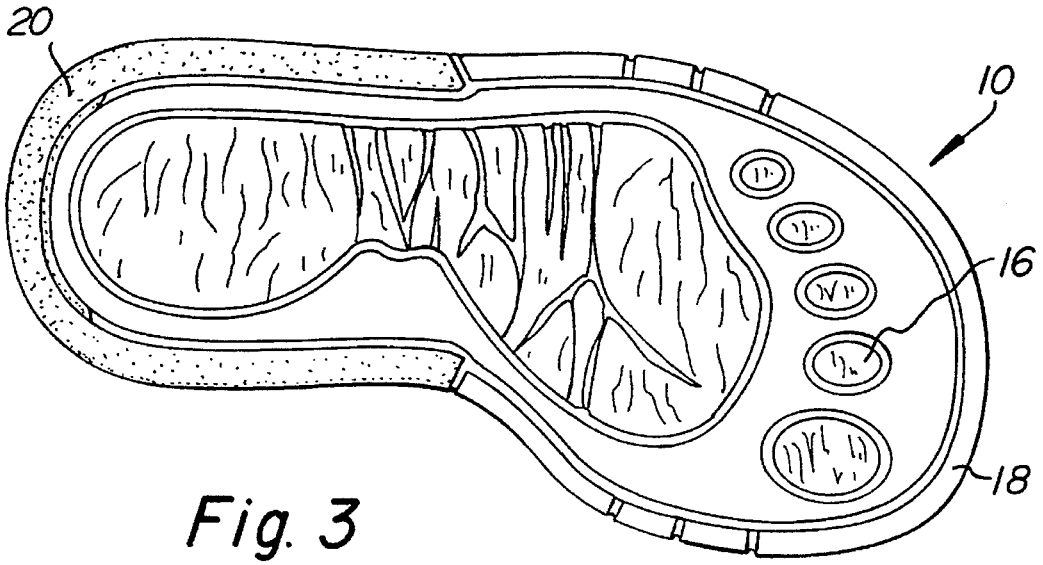
FIG. 3 is a bottom plan view of the sole depicted in FIG. 1.

With reference now to the drawings in which like numerals represent like elements throughout the views, a sole 10 according to the present invention is depicted in FIGS. 1 to 5. Sole 10 has been depicted as part of a shoe 12 with an upper 14 shown in phantom in FIG. 2. Upper 14 is attached to sole 10 to form shoe 12 in a manner well known in the art, such as by gluing or the like. It will be appreciated that shoe 12 is designed to be used by small children just learning to walk, so that sole 10 has special characteristics to help a child learn to walk properly (and possibly to help correct some improper walking techniques).

Sole 10 in this preferred embodiment includes three distinct and interacting parts: a base plate 16, a stabilizing plate 18, and a heel member 20. Preferably, base plate 16, stabilizing plate 18, and heel member 20 of sole 10 are all made of the same material, but with different hardness (or softness) so that different cushioning is provided by the different parts according to the function of the part. A suitable and currently preferred material is styrene-butadiene-styrene (SBS), which is easily provided in different hardnesses as desired. The currently preferred hardness values for the parts of shoe 12 are: base plate 16 has a durometer value of 40 (soft); stabilizing plate 18 has a durometer value of 53 (semi-soft); and heel member 20 has a durometer value of 65 (hard). The reason for the choice of the different hardnesses will be explained subsequently. Advantageously, the different parts can also be dyed different colors for aesthetic purposes.

Figure 4:
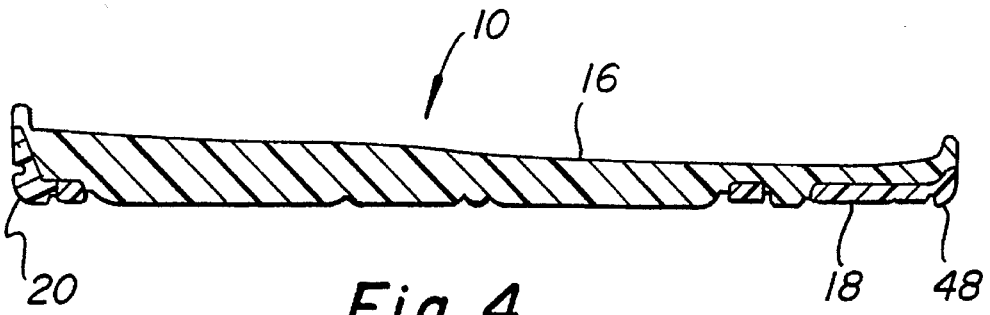
FIG. 4 is a cross-sectional view of the sole taken along the line 4-13 4 of FIG. 1.
Figure 5:
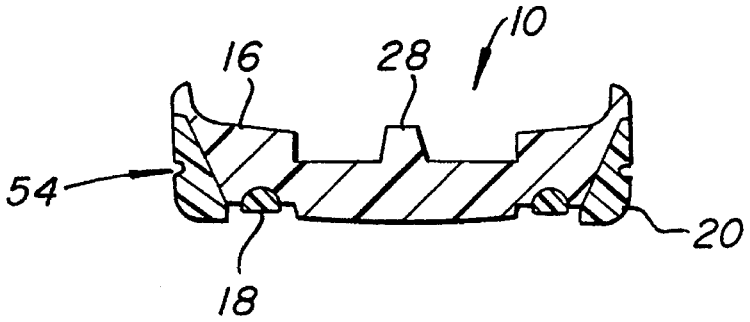
FIG. 5 is a cross-sectional view of the sole taken along the line 5—5 of FIG. 1.
Figure 7:
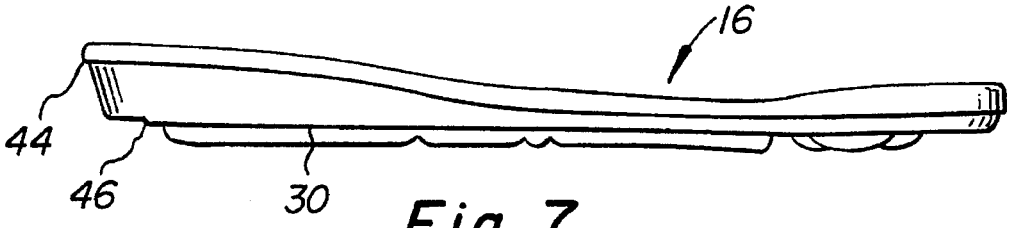
FIG. 7 is a side elevation view of the base plate depicted in FIG. 6.
Figure 6:
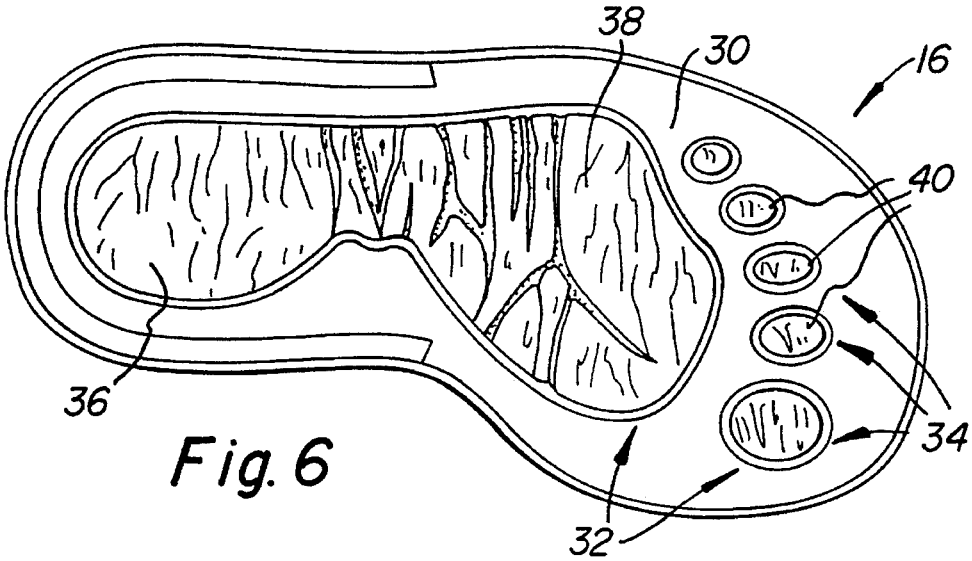
FIG. 6 is a bottom plan view of the base plate of the sole depicted in FIGS. 1–5.

As shown with more clarity in FIGS. 6 and 7, base plate 16 forms the primary part of sole 10. Base plate 16 includes an upper surface 22 to which upper 14 is attached. Upper surface 22 is generally concave as shown in FIGS. 4 and 5, with a peripheral portion 24 to which upper 14 is cemented or otherwise attached. Centrally between peripheral portion 24 and adjacent the position taken by a heel of a foot of a user of shoe 12, reduced areas or cavities 25 defined by four lateral bars 26 and an integral central longitudinal bar 28 are provided. By use of bars 26 and 28 at this location, the cushioning of the heel of the user is increased during impact with the ground, and the bounce back from the ground is also increased.

Base plate 16 also includes a lower surface 30. Lower surface 30 is formed with a footprint embossing 32 which is opposite to the foot of the user. The embossing 32 extends nearly the entire length of the base plate 16 as seen in FIG. 6. Footprint embossing 32 includes a toe portion 34 which is separate from a remainder of footprint embossing 32, which remainder comprises a heel area 36 and a ball area 38 which are joined. In this preferred embodiment, toe portion 34 is shown as including separate toe-print areas 40, though it would be possible to form toe portion 34 as a single band. All of the areas of footprint embossing 32 have small ridges or valleys therein to mimic a bare foot, and thus to provide for better traction and flexibility. It will be appreciated that footprint embossing 32 is the primary part of sole 10 contacting the ground, and that base plate 16 is made from the least hard material. Thus, base plate 16 provides the softest part of sole 10 at the location of the footprint of the user during a normal (forward moving) stride.

Figure 9:
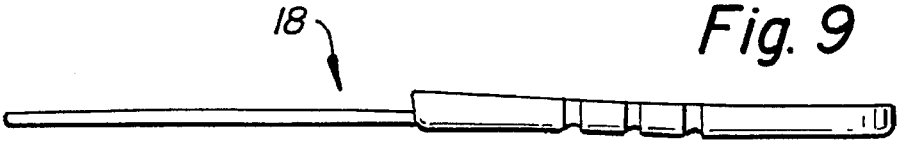
FIG. 9 is a side elevation view of the stabilizing plate depicted in FIG. 8.
Figure 8:
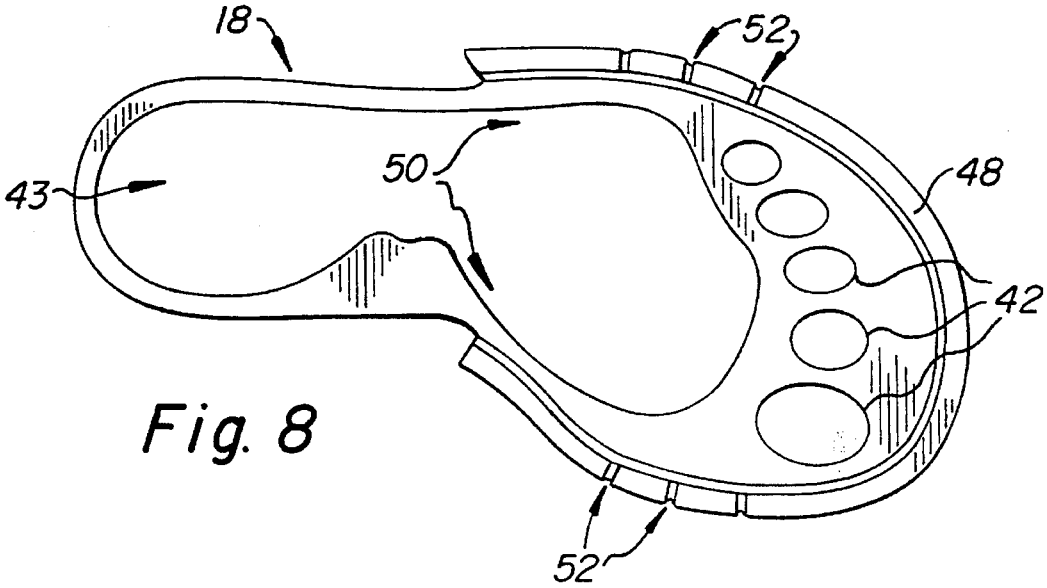
FIG. 8 is a bottom plan view of the stabilizing plate of the sole depicted in FIGS. 1–5.

As shown with more clarity in FIGS. 8 and 9, stabilizing plate 18 is designed to be located horizontally about and surrounding footprint embossing 32 while being attached to base plate 16. For this purpose, stabilizing plate 18 includes toe apertures 42 through which each of the individual toe-print areas 40 extend and a large heel/ball aperture 43 through which heel area 36 and ball area 38 extend. As shown best in FIGS. 4 and 5, the upper and outer edge of stabilizing plate 18 at the front and side is located beneath a ridge 44 formed in the side of base-plate 16, while at the back the upper edge is trapped between a step 46 formed in lower surface 30 and heel member 20. Otherwise, the adjacent areas of stabilizing plate 18 are attached to the mating surfaces of base plate 16 and heel member 20.

As shown in FIGS. 4 and 5, the outer and lower edge of stabilizing plate 18 includes a small lip 48 which extends from one side of stabilizing plate 18 adjacent the arch or ball area 38 of the user to the other side. Lip 48 is slightly lower (extends downwardly) than the adjacent interior portion of stabilizing plate 18 so that lip 48 contacts the surface ahead of adjacent areas when the user is walking. In addition, as the remaining portions of stabilizing plate 18 also do not extend as far down as footprint embossing 32, footprint embossing 32 engages the walking surface together with lip 48—until footprint embossing 32 is compressed (as it is softer than the material of stabilizing plate 18) and the remainder of stabilizing plate 18 contacts the walking surface. This provides for a very comfortable stepping process for the user.

It will be appreciated that stabilizing plate 18 includes a bridge portion 50 which extends outwardly from toe portion 34. Bridge portion 50 and especially lip 48, which is made harder (semi-soft) compared to the material of base plate 16 (soft), thus provides a lateral stability for toe portion 34 and the whole front part of the foot during walking. In particular, bridge portion 50 helps to prevent the toes and ball area of the user from shifting laterally across base plate 16 during walking, as might occur when the relatively softer material of toe-print areas 40 and ball area 38 are subject to a lateral force.

It will also be appreciated that stabilizing plate 18 includes a plurality of flex vents 52 in an outer edge thereof adjacent ball area 38. Flex vents 52 provide the harder (than base plate 16) material of stabilizing plate 18 with an easier bending at this location, which is where the foot and sole 10 naturally tend to bend during walking.

Figure 11:
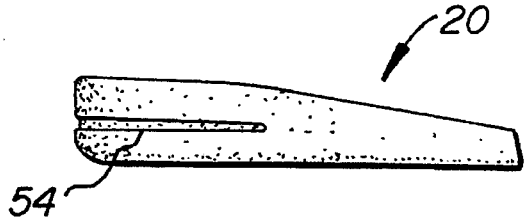
FIG. 11 is a side elevation view of the heel member depicted in FIG. 10.
Figure 10:
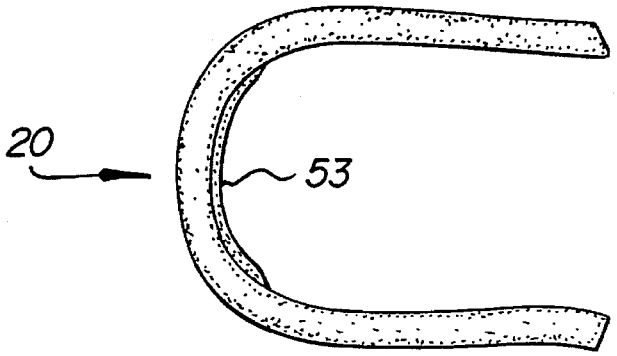
FIG. 10 is a bottom plan view of the heel member of the sole depicted in FIGS. 1–5.

As shown with more clarity in FIGS. 10 and 11, heel member 20 is designed to be located horizontally about and attached to base plate 16 and stabilizing plate 18 in the heel of sole 10. As shown best in FIGS. 4 and 5, the upper and outer edge of heel member 20 at the back and side is located beneath ridge 44 formed in the side of base plate 16, while otherwise the adjacent areas of heel member 20 are attached to the mating surfaces of base plate 16 and stabilizing plate 18. The mating surfaces between heel member 20 and stabilizing plate 18 as shown in FIG. 4 occur only along a back portion thereof where extension 53 is provided as best shown in FIG. 10. The mating contact of heel member 20 with stabilizing plate 18 is thus eliminated at the position of the side of heel member 20 as shown in FIG. 5.

The lower surface of heel member 20 extends downwardly past the adjacent portion stabilizing plate 18, to a level approximately equal to the lowest part of footprint embossing 32 at the center of the heel area 36. However, as heel member 20 is made of a much harder material than footprint embossing 32 (and somewhat harder than the material of stabilizing plate 18), it will be appreciated that heel member 20 provides a distinct heel stability for sole 10 during walking while still affording a cushioned area for the heel of the user (engaging the walking surface primarily through footprint embossing 32). In particular, heel member 20 helps to keep the heel of the user in place while walking forward.

Heel member 20 also includes a small lateral groove 54 about the back thereof, to provide a small additional flexibility to the back of heel member 20. Thus, when walking and the back of heel member 20 first contacts the walking surface before anything else (and especially footprint embossing 32), some small cushioning is effected without affecting the great lateral stability afforded by heel member 20 as the rest of heel member 20 (and thus footprint embossing 32) comes in contact with the walking surface.

It has been indicated above that base plate 16, stabilizing plate 18 and heel member 20 are attached to one another. In the preferred process of making sole 10, an injection process and mold are provided so that the three different (by hardness) SBS materials of the parts are sequentially injected as a molten (and hot) material. Preferably, heel member 20 is first formed in the mold by injecting the relatively hard (when cooled) SBS material, and after cooling certain mold parts (including dams) are then removed. The semi-soft (when cooled) material for stabilizing plate 18 is then injected, and after cooling thereof and further adjustments of the mold, the soft material for base plate 16 is injected. As the materials for both stabilizing plate 18 and base plate 16 are injected as a hot liquid, there is a fusing with the already present material(s) so that a firm attachment of the materials is achieved. However, it will be appreciated by those of ordinary skill that other attachment mechanisms could also be used where a different forming processes is desired. For example, the parts could be formed separately, and then joined such as by cementing, if desired.

While sole 10 of the present invention has been shown with a separate heel member 20, heel member 20 could also be formed simply as a part of stabilizing plate 18. This could be done if a large heel stability were not required for the shoe, so that the relatively semi-hard material of stabilizing plate 18 would provide sufficient heel stability relative to the soft material of base plate 16.

Sole 10 has also been described above as being especially designed for use by small children just learning to walk or to walk correctly. However, sole 10 could also be used for comfort and/or to correct small improper walking tendencies (such as pigeon toe or pronation) by users of all ages. As the size of the foot increases, it will also be appreciated that the thickness of the various portions would also increase to accommodate the increased forces and pressures exerted by a larger and heavier user.

While the present invention has been described with respect to exemplary embodiments thereof, it will be understood by those of ordinary skill in the art that variations and modifications can be effected within the scope and spirit of the invention.

We claim:

1. An integrally molded sole for a shoe of a child learning to walk comprising:

a molded base plate which is made of a molded synthetic resin material and which forms a cushioning layer, said base plate having a length and including an upper surface to which an upper of the shoe is to be attached, a lower surface, and a footprint embossing extending from said lower surface opposite the position taken by a foot of a user in the upper and extending nearly the entire length of the base plate, said footprint embossing including a toe portion separated from a remainder of said footprint embossing by a space, said footprint embossing engaging a walking surface when the shoe is worn and providing traction and comfort for the footprint area of the foot of the user; and a stabilizing plate horizontally located about and separately surrounding said toe portion and said remainder of said footprint embossing of said base plate, said stabilizing plate filling said space between said toe portion and said remainder of said footprint embossing, being molded to said lower surface of said base plate, being made of a molded synthetic resin material which is harder than the synthetic resin material of said base plate, also engaging the walking surface, and including a bridge portion extending outwardly from said toe portion of said footprint embossing which said bridge portion provides lateral stability for the sole.

2. An integral sole for a shoe as claimed in claim 1 wherein said toe portion includes five separate toe-print areas located opposite to the corresponding toe-prints of the foot of the user, and said separate toe-print areas are separated by additional spaces; and wherein said stabilizing plate fills said additional spaces.

3. An integral sole for a shoe as claimed in claim 1 wherein said remainder of said footprint embossing includes a heel area and a ball area which are joined.

4. An integral sole for a shoe as claimed in claim 1 and further including a heel member which is U-shaped in plan view and which is located peripherally about a heel portion of said stabilizing plate and a heel portion of said remainder of said footprint embossing with respective ends of the U-shape adjacent said bridge portion and which is molded to said base plate and to said stabilizing plate, said heel member being made of a synthetic resin material which is harder than the synthetic resin material of said stabilizing plate to provide a firm heel stability for the shoe.

5. An integral sole for a shoe as claimed in claim 4 wherein said heel member includes a lower surface which is located vertically below an adjacent lower surface of said stabilizing plate and vertically equal to a lowest portion of an the heel portion of said footprint embossing of said base plate.

6. An integral sole for a shoe as claimed in claim 4 wherein said base plate, said stabilizing-plate and said heel member are made of a styrene-butadiene-styrene material.

7. An integral sole for a shoe as claimed in claim 6 wherein said material of said base plate has a durometer value of 40, said stabilizing plate has a durometer value of 53, and said heel member has a durometer value of 65.

8. An integral sole for a shoe as claimed in claim 1 wherein said stabilizing plate has an outer edge which extends about a toe end of the sole, and wherein said outer edge laterally adjacent a ball area of said footprint embossing includes a plurality of flex vents therein which extend inwardly and upwardly from said outer edge.

9. An integral sole for a shoe as claimed in claim 1 wherein said footprint embossing has a lower surface which is located vertically below a lower surface of said stabilizing plate adjacent thereto.

10. An integral sole for a shoe as claimed in claim 9 wherein said stabilizing plate includes an outer edge extending from one side of a ball area of said footprint embossing around the toe end to the other side of the ball area, said outer edge including a depending lip which extends vertically downwards beyond a remainder of said stabilizing plate and vertically downwards to the same position as the lower surface of said footprint embossing.

11. An integral sole for a shoe as claimed in claim 9 wherein said footprint embossing includes ridges and valleys in the lower surface thereof.

12. An integral sole for a shoe as claimed in claim 1 wherein said base plate includes cavities in a heel portion of said upper surface.

13. An integrally molded sole for a shoe of a child learning to walk comprising:

a molded base plate which is made of a molded synthetic resin material and which forms a cushioning material, said base plate having a length and including an upper surface to which an upper of the shoe is to be attached, and a lower surface, and a footprint embossing extending from said lower surface opposite the position taken by a foot of a user in the upper and extending nearly the entire length of the base plate, said footprint embossing having five separate toe-print areas located opposite to the corresponding toe-prints of the foot of the user and separated by spaces from each other and from a heel area and a ball area which are joined and which are separated from said toe-print areas by additional spaces, said footprint embossing thus engaging a walking surface when the shoe is worn and providing traction and comfort for the footprint area of the foot of the user;

a stabilizing plate horizontally located about and separately surrounding said toe-print areas and said joined heel and ball areas said footprint embossing of said base plate, said stabilizing plate filling said spaces and said additional spaces between said toe-print areas and said heel and ball areas, being molded to said lower surface of said base plate, being made of a molded synthetic resin material which is harder than the synthetic resin material of said base plate, also engaging the walking surface, and including a bridge portion extending laterally outwardly from a toe portion of said footprint embossing which said bridge portion provides lateral stability for the sole; and a heel member which is U-shaped in plan view and which is located peripherally about a heel portion of said stabilizing plate and the heel area of said footprint embossing with respective ends of the U-shape adjacent said bridge portion and which is molded to said base plate and to said stabilizing plate, said heel member being made of a synthetic resin material which is harder than the synthetic resin material of said stabilizing plate to provide a firm heel stability for the shoe.

14. An integral sole for a shoe as claimed in claim 13 wherein said heel member includes a lower surface which is located vertically below an adjacent lower surface of said stabilizing plate and vertically equal to a lowest portion of the heel area of said footprint embossing of said base plate; and wherein said stabilizing plate includes an outer edge extending from one side of a ball area of said footprint embossing around the toe end to the other side of the ball area, said outer edge including a depending lip which extends vertically downwards beyond a remainder of said stabilizing plate and vertically downwards to a same vertical position as the lower surface of said footprint embossing.

15. An integral sole for a shoe as claimed in claim 14 wherein the lower surface of said footprint embossing is located vertically below the lower surface of said stabilizing plate adjacent thereto; and wherein said footprint embossing includes ridges and valleys in the lower surface thereof.

16. An integral sole for a shoe as claimed in claim 15 wherein said base plate includes cavities in a heel portion of said upper surface; and wherein said outer edge laterally adjacent a ball area of said footprint embossing includes a plurality of flex vents therein which extend inwardly and upwardly from said edge.

17. An integral sole for a shoe as claimed in claim 16 wherein said base plate, said stabilizing plate and said heel member are made of a styrene-butadiene-styrene material.

18. An integral sole for a shoe as claimed in claim 17 wherein said material of said base plate has a durometer value of 40, said stabilizing plate has a durometer value of 53, and said heel member has a durometer value of 65.

* * * * *